United States Patent [19]

Haroutel et al.

[11] Patent Number: 4,633,644

[45] Date of Patent: Jan. 6, 1987

[54] DEVICE FOR INSERTING BUNDLES INTO ENVELOPES

[75] Inventors: Jean-Claude Haroutel, Orsay; Christian Galceran, Ballancourt sur Essonne, both of France

[73] Assignee: Societe Anonyme dite: SMH ALCATEL, Paris, France

[21] Appl. No.: 775,557

[22] Filed: Sep. 13, 1985

[30] Foreign Application Priority Data

Sep. 14, 1984 [FR] France ..... 84 14141

[51] Int. Cl.[4] ..... B65B 5/00

[52] U.S. Cl. ..... 53/258; 53/260; 53/266 A

[58] Field of Search ..... 53/252, 255, 257, 258, 53/260, 261, 262, 266 R, 266 A, 387, 251

[56] References Cited

U.S. PATENT DOCUMENTS

| | | | |
|---|---|---|---|
| 2,584,497 | 2/1952 | Poole | 53/255 |
| 2,590,327 | 3/1952 | Kay | 53/257 |
| 2,850,855 | 9/1958 | Offutt | 53/258 X |
| 3,412,995 | 11/1968 | Parups | 271/268 |
| 3,530,975 | 9/1970 | Thumin et al. | 198/719 |
| 3,774,367 | 11/1973 | Lerner | 53/261 X |
| 3,832,822 | 9/1974 | Sherman | 53/387 X |
| 4,169,341 | 10/1979 | Roetter et al. | 53/266 A X |
| 4,202,153 | 5/1980 | Lerner et al. | 53/258 X |
| 4,543,768 | 10/1985 | Nishikawa et al. | 53/260 X |

FOREIGN PATENT DOCUMENTS

| | | | |
|---|---|---|---|
| 597714 | 2/1948 | United Kingdom | 53/266 A |
| 2083791 | 3/1982 | United Kingdom . | |

*Primary Examiner*—John Sipos
*Assistant Examiner*—Steven P. Weihrouch
*Attorney, Agent, or Firm*—Sughrue, Mion, Zinn, Macpeak & Seas

[57] ABSTRACT

A device for inserting bundles into envelopes comprises a table fastened to a drive carriage for receiving the bundle and inserted with it into the envelope. A pair of retractable pusher fingers on support arms fastened to the carriage push the bundle on the table during the forward stroke of the carriage and retract during the return stroke of the carriage. The device is usable in automatic mail processing systems.

14 Claims, 4 Drawing Figures

DEVICE FOR INSERTING BUNDLES INTO ENVELOPES

BACKGROUND OF THE INVENTION

1. Field of the invention

The present invention relates to the automatic insertion of bundles of documents into envelopes, in particular in automatic mail processing machines.

2. Description of the prior art

Bundles to be inserted successively into envelopes may be formed of one or more sheets. In an automatic mail processing machine the insertion into envelopes is effected at the output from a folder or from a device for assembling or transporting bundles. The insertion devices may comprise pusher tabs or insert rollers which push the bundle into an envelope extracted from a pile of envelopes and offered up open on the trajectory of the bundle.

There is known, for example, from U.S. Pat. No. 3,412,995 a device of this kind with fingers which hold the bundle against the surface of a table to transfer them from a bundle entry station to an open envelope holding station. According to this document, the table is fixed to an upper frame on a carriage reciprocated in translation on guide rods. The clamping fingers are formed at the end of a pivoting arm inside the frame. By means of appropriate openings in the table, these fingers can be raised above the table or retracted. For the purpose of controlling the fingers, the arm is urged into a position such that its fingers are retracted but carries on its lower edge a peg which, in bearing on a guide surface provided in one of the rods, causes the raising of the fingers at the ends and beginnings of the forward and return strokes of the assembly. The guide surface defines a higher level on which the peg bears at the ends and beginnings of the forward and return strokes and a lower bearing level between these, transitional ramps linking the higher and lower levels.

During the forward stroke, the fingers are initially raised. The peg reaching the first transitional ramp corresponds to the raised fingers reaching the bundle. This transitional ramp then allows the fingers to drop so as to clamp against the surface of the table the bundle which is thus transported and inserted into the envelope. At the end of the same forward stroke the second transitional ramp causes the fingers to be raised again and release the bundle which is then pushed fully into the envelope.

During the return stroke, the clamping fingers are retracted during the travel of the peg over the lower level of its guide surface.

A device of this kind protects the bundle during its insertion into the envelope by virtue of the insertion of the table with the bundle into the envelope. On the other hand, the action of the clamping fingers urged into bearing engagement on the bundle and retained by the bundle during its transportation may damage it prior to its insertion and is therefore unsatisfactory.

One specific objective of the present invention is to eliminate this disadvantage. Another objective of the invention is to provide for the proper insertion of bundles of varying size into corresponding envelopes with the bundles protected throughout such insertion.

SUMMARY OF THE INVENTION

The present invention consists in a device for inserting bundles into envelopes, comprising:

- a fixed bundle entry station,
- a fixed open envelope holding station facing and spaced from said entry station,
- guides and a carriage movable in translation on said guides,
- a bundle receiving table extending under said entry station and carried by said carriage,
- drive means for reciprocating said carriage, by virtue of a forward stroke and return stroke, between two positions one of which is a working position in which said table is inserted in the envelope and the other of which is an idle position in which it is below said entry station,
- retractable pusher fingers attached to said carriage which are raised to form an abutment for said bundle on the forward stroke and retracted on the return stroke,
- parallel support arms extending between the levels defined by said entry station and said table and carrying said pusher fingers which are pivoted with longitudinal play to first end portions of said support arms, and
- coupling means between said support arms and said carriage comprising at least elastic first linking means for relative translation to the extent of said longitudinal play of said pusher fingers on said support arms, between the forward stroke and the return stroke and vice-versa, for which said pusher fingers are respectively raised on said support arms to form an abutment for the bundle and retracted.

Other characteristics and the advantages of the present invention will emerge from the following description of one embodiment given by way of non-limiting example with reference to the accompanying drawings.

DESCRIPTION OF THE PREFERRED EMBODIMENT

Figure 1:
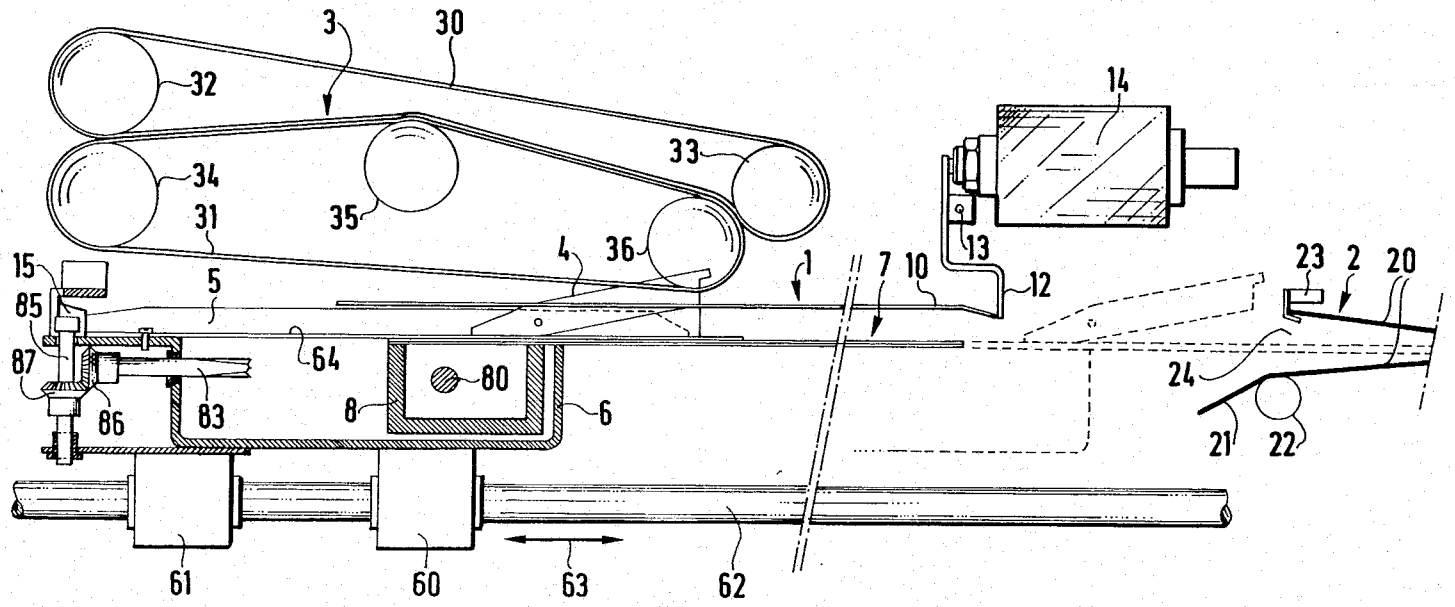
FIGS. 1 and 2 are two views of the device in accordance with the invention for inserting bundles into envelopes, FIG. 1 being a cross-section on the line I—I in FIG. 2 and FIG. 2 being a plan view of the device of FIG. 1, shown without the bundle guide and entry means, and partially cut away.

With reference to FIG. 1, it is seen that the device for inserting a bundle into an envelope has a bundle entry station 1 and an open envelope holding station 2 facing the bundle entry station.

On the upstream side of the bundle entry station is a bundle guide path 3 defined by endless belts or bands 30 and 31 disposed between sets of pulley wheels 32 and 33 in the case of the upper belt 30 and 34, 35 and 36 in the case of the lower belt 31. This guide path connects the output from an automatic folder (not shown) to the entry station 1, for example.

The bundle entry station 1 is defined by a fixed plate 10 extending under the bundle guide path 3 and projecting beyond the two end pulleys 33 and 36 of the guide path towards the envelope holding station 2.

The plate 10 is at a distance from the envelope holding station 2. Facing this station 2, the edge of the plate 10 is inclined to the horizontal and is barred by the end of an abutment member 12 called the bundle constituting abutment member. This abutment member is pivoted about an axis 13 by a solenoid 14 the moving arm of which is coupled to the other end of the abutment member. This pivoting of the abutment member enables the bundle to be released from the entry station for its insertion in an envelope.

The envelope holding station 2 holds the envelope 20 immobile with its open side facing the station 1. This envelope holding station 2 normally constitutes the output from a device for extracting envelopes from a magazine or a mechanism for transporting envelopes taken one by one from a magazine, not shown since it does not form part of the present invention. Consequently, the station 2 is shown schematically as being formed by two holding slideways 22 and 23 defining between them a bundle insertion opening 24; the flap 21 of the envelope passes over one of the slideways, the other slideway enabling the rear surface of the envelope to be held at a distance from its front surface, so as to open the envelope across the width of the opening 24.

Figure 2:
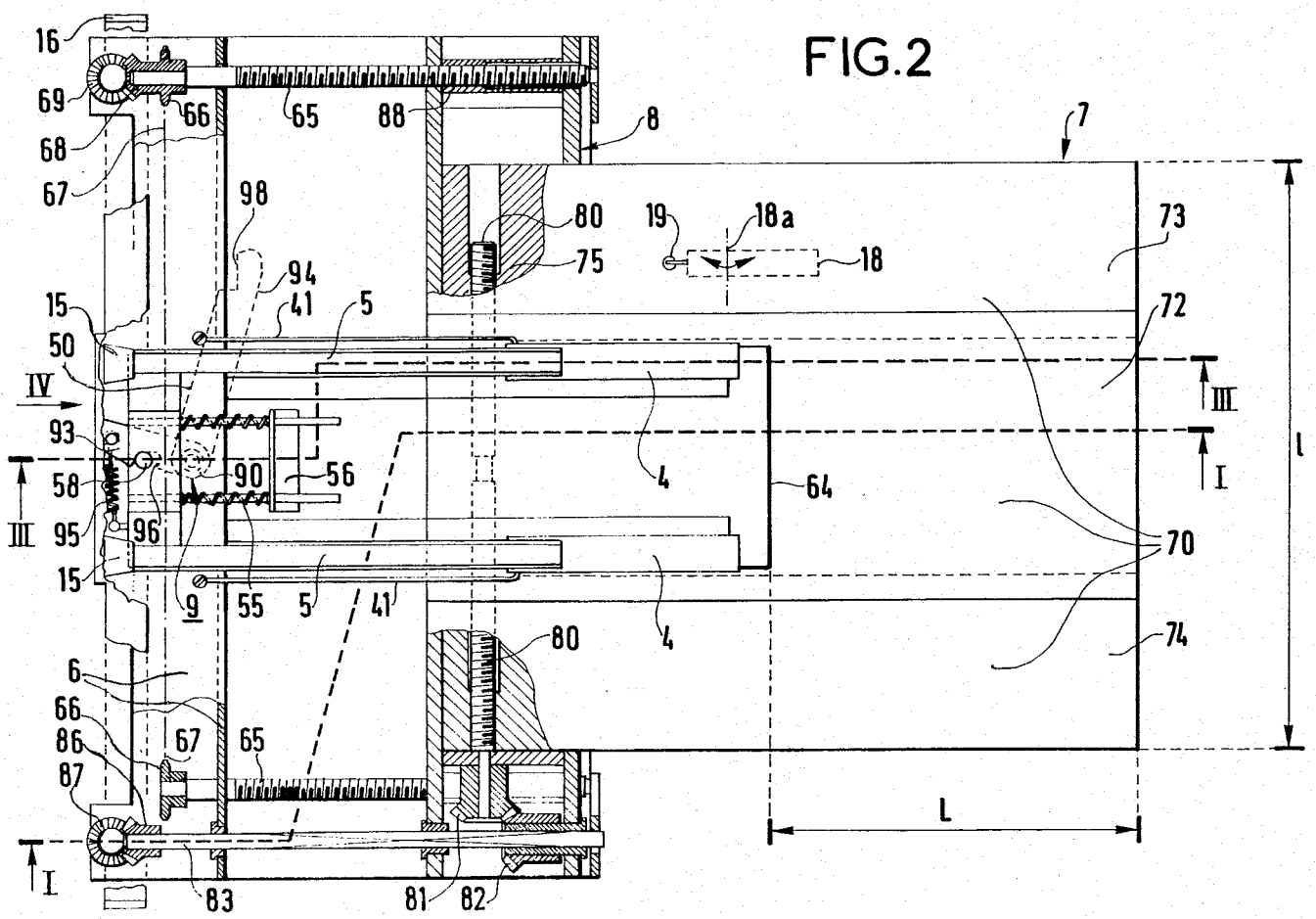

With reference to FIG. 1 and/or FIG. 2 in which, to clarify the diagram, the plate 10 and the guide path 3 are not shown, it is seen that the device essentially comprises two identical retractable pusher fingers 4 which are individually mounted on the facing end portions of two parallel support arms 5 fastened to a carriage 6 and a table 7 also fastened to the carriage 6.

The carriage 6 is U-shaped with the table 7 extending over it on one side. It has at the end of one of its branches a horizontal lip extending away from the table.

The carriage 6 is equipped with guide bushes 60, 61 for the slideways 62. It is reciprocated on its slideways 62 by a crank and crankshaft type drive mechanism coupled to the bush 60. As this drive mechanism is well known per se, it has not been shown in the diagrams, and in particular in FIG. 1, so as to enable the essential component parts of the device to be shown to a suitable scale. It has merely been symbolically represented by an arrow 63. It drives the carriage 6 between two defined limit positions, one called the idle position in which the device is shown and the other called the working position in which the carriage 6, the table 7 and the pusher fingers 4 are as indicated in dashed line in FIG. 1. In this working position the fingers are just in front of the opening 24 and the table 7 is in the envelope 20.

The support arms 5 and the pusher fingers 4 extend over the table 7. They are separated from one another by a distance slightly greater than the width of the plate 10. The ends of the pusher fingers 40 are disposed at substantially the same level as the median part of the table 7; they expose the forward part 70 of the table 7 for receiving the bundle evacuated from the entry station 1. At the end opposite the pusher fingers 4 the support arms 5 are connected by a crossmember 50. The connection between the support arms 5 and the carriage 6 is made on the crossmember 50.

The table 7 extends below the entry station 1. In terms of levels, it is offset from the plate 10 by a distance slightly greater than the height of the support arms relative to the table 7, but less than the height of the non-retracted pusher fingers relative to the table. Thus the pusher fingers which lie one on each side of the plate 10 are above the level of the plate when they are not retracted, whereas they are withdrawn below the level of the plate and can pass under the non-retracted abutment member 12 when they are retracted.

Figure 4:
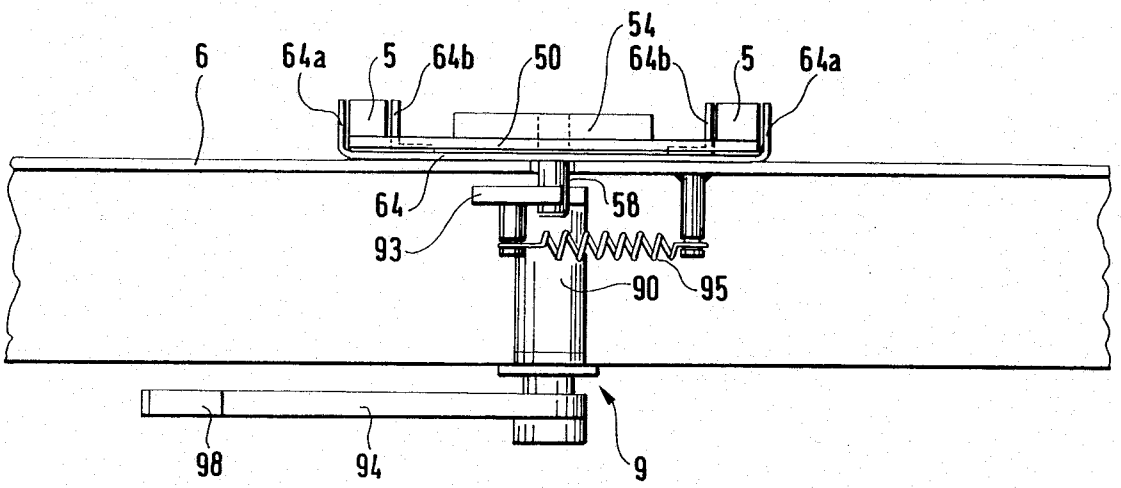
FIG. 4 is a partial schematic view of the device as seen in the direction of arrow IV in FIG. 2, also to a larger scale.

A shelf 64 fixed to the carriage 6 extends at substantially the same level as the table 7, which it partially overlaps. The width of this shelf 64 is slightly greater than the overall separation of the support arms 5. The shelf has two folded up longitudinal edges **64*a* which extend externally along the support arms 5 and carry two angle brackets 64*b* which extend internally along the support arms (FIG. 4**).

The table 7 is mounted on an auxiliary carriage 8 which is accommodated in the carriage 60 and is coupled to it for the purpose of driving the table 10. The connection between the table 7 and the carriage 6 is provided by a pair of rods 65 disposed between the carriage 6 and the auxiliary carriage 8.

Figure 3:
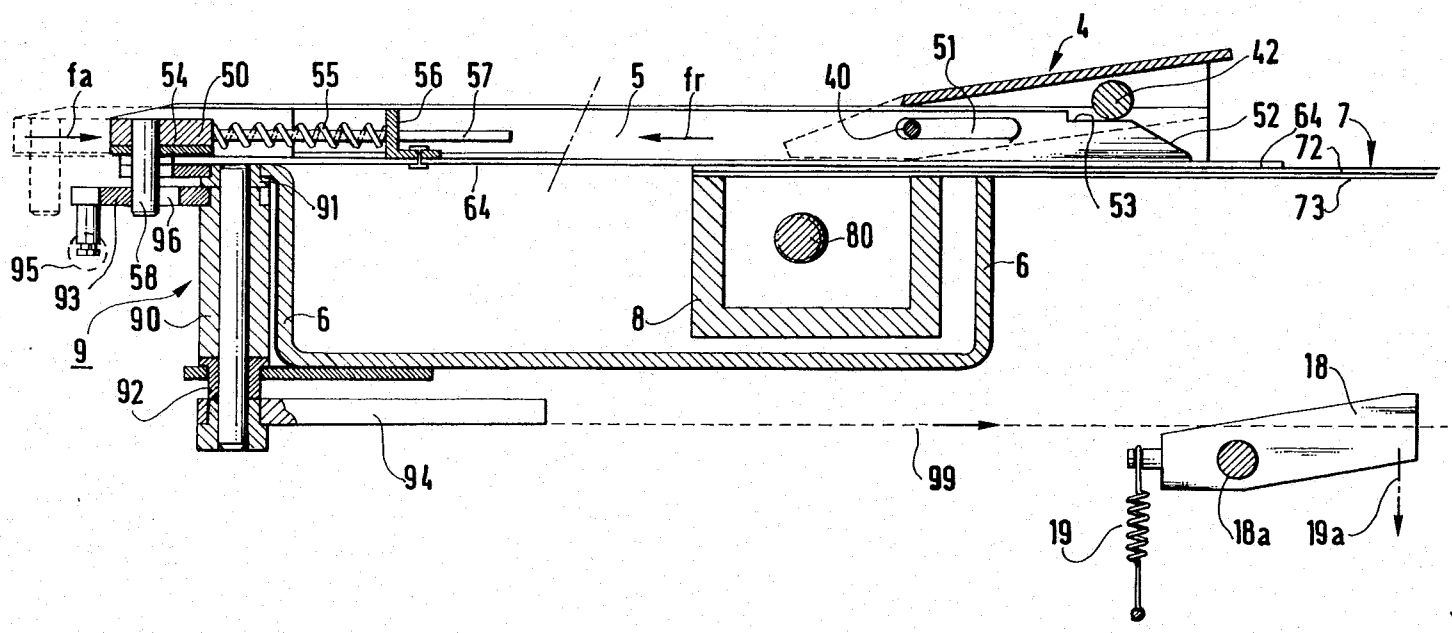
FIG. 3 is a view of the device in crosssection on the line III—III in FIG. 2, to a larger scale and not showing the bundle guide and entry means.

The mounting of the pusher fingers 4 on the end portions of the support arm will be described with particular reference to FIG. 3.

These pusher fingers 4 are pivoted to the end portions of the support arms. They are of inverted U-shape and fit over the end portions of the support arms. Each carries a pin 40 mounted between the sides of the U-shape. This pin is inserted into an oblong opening or slot 51 in the end portions of the support arms; it defines the finger pivot axis. Spring rods 41 are mounted along the outside of the support arms 5, between the end of the pin retaining each pusher finger and the carriage 6 (FIG. 2). These spring rods 41 are stiff and of arcuate shape, functioning in bending and providing an elastic coupling urging the pusher fingers 4 into their retracted position.

The openings 51 through which the pins 40 pass provide longitudinal play of the support arms 5 relative to the pusher fingers 4, the pivot axes of which are held by the spring rods 41 relative to the carriage 6.

The end portion of each support arm 5, on the inside of the pusher finger, is shaped to define an end inclined ramp or surface 52 and an intermediate horizontal plateau 53. Correspondingly, each pusher finger carries a bottom roller 42 mounted transversely between the sides of the U-shaped profile. This roller rests on the plateau 53 or the ramp 52, according to the position adopted by the support arms 5 relative to the pusher fingers. When it bears on the plateau 53 it holds the end of the pusher finger in the raised position on the support arm. It is guided along the ramp 52 during the displacement of the opening 51 on the pin 40, to pivot the pusher finger. When it bears on the end of the support arm, at the lower level of the ramp 52, the pusher finger is retracted, simply capping the end portion of the support arm.

The linkage between the carriage 6 and the support arms 5 for driving the support arms and controling pivoting of the fingers will now be described with reference to FIGS. 2, 3 and 4.

The carriage 6 is elastically coupled to the support arms 5 by a pair of springs 55. These springs 55 are mounted on supporting rods 57 between a support 54 fixed to the crossmember 50 linking the support arms 5 and an abutment angle bracket 56 fixed to the shelf 64 mounted on the carriage 6. Associated with this elastic coupling between the carriage 6 and the support arms 5 is a supplementary mechanism 9 coupled to the carriage 6. This mechanism comprises a hub 90 mounted by rings 91, 92 between the horizontal lip and the bottom of the carriage 6. This hub extends slightly beyond the height of the carriage. It carries at its end two pawls 93 and 94, the pawl 93 extending under the crossmember 50 being referred to as that for placing the pusher fingers 4 in the non-retracted position and the pawl 94 extending under the carriage 6 being referred to as that for placing the pusher fingers 4 in the retracted position.

The pawls 93 and 94 are disposed substantially at right angles to one another on the hub. The pawl 93 is held substantially transversely to the support arm 5 by a return spring 95 fixed to the carriage 6. It has a notch 96 in its side. This pawl 93 cooperates with a pin 58 carried by the support 54 fixed to the crossmember 5 linking the support arms 5, this pin passing through the horizontal lip of the carriage 6 and the shelf 64 separating the crossmember and the pawl. When it is engaged in the noth 96 in the pawl, the pin 58 constitutes a non-elastic coupling between the carriage and the support arms 5, being substituted on the forward stroke of the carriage for the elastic coupling implemented by the springs 55. When this pin 58 is engaged in the notch 96 in the pawl 93, the springs 55 are compressed and draw back the support arms by bringing the lefthand end of the openings 51 over the pins 40 as shown in FIG. 3 so as to lock the pusher fingers 4 in the non-retracted position.

Associated with the pawl 93 and the pin 58 are a pair of buffer abutments 15 fixed in position in the device. These buffer abutments are disposed facing the support arms 5 on a crossmember 16 of the device, the abutments 15 and the crossmember 16 being visible in FIG. 2 but not shown in FIGS. 3 and 4 to clarify the illustration. These abutments 15 limit the travel of the support arms 5 driven by the carriage when the carriage arrives at the idle position. These abutments lock the pin 58 in the groove 96 when the carriage 6 arrives at the idle position, this pin being outside the notch 96 during the return stroke of the carriage 6.

The pawl 94 has a notch 98 in its side at the end (FIGS. 2 and 4). It cooperates with a pivotable abutment member 18 (FIGS. 2 and 3) disposed on the trajectory of the pawl 94 schematically represented by the chain-dotted lines 99 in FIG. 3. This abutment member 18 is mounted to pivot about an axis 18*a* in the device and is spring-loaded by means of a spring 19 so as to permit the free engagement of the end of the pawl over its forward end and then its retraction by pivoting in the direction of the arrow 19*a* towards the end of the forward stroke of the carriage 6. In the working position of the carriage, that is to say at the end of the forward stroke, the pawl 94 is beyond the abutment member 18 which, released, has swung back due to the action of the spring 19.

For the return stroke of the carriage 6, this abutment member 18 forms a non-retractable obstacle, however. The notch 98 in the side of the pawl 94 is then engaged over the rear edge of the abutment member 18. The retention of the pawl 94 on the abutment member 18 causes the pawl 94 to pivot about the axis of the hub 90 to move the pawl 94 along the abutment member 18. This pivoting of the pawl 94, transmitted to the pawl 93, unlocks the pin 58 from its notch 96 to remove the non-elastic coupling between the carriage and the support arms, as effected by the pin 58 in the notch 96 in the pawl 94, leaving only the elastic coupling implemented by the springs 55. At the same time due to the action of the springs 55 operative in compression on the crossmember 50, the support arms 5 are subject to a displacement in the direction of the arrow fr relative to the carriage 6. The position of the support arms relative to the carriage for the return stroke of the carriage is outlined in dashed line to the left in FIG. 3. By virtue of this displacement in the direction of the arrow fr, the opening 51 has slid over the pin 40 and the rollers 42 have slid along the ramp 52. Given these conditions, the spring rods 41 urge the pusher fingers 4 into the retracted position. The return stroke of the carriage 6, to the idle position, is thus effected with the fingers retracted.

The duration of the return stroke with pusher fingers retracted is advantageously employed to feed a bundle to be placed in an envelope to the entry station 1 closed by the abutment member 12, this bundle arriving on the plate 10 already formed of one or more sheets or being made up on the plate 10 by the accumulation of individual sheets arriving one after the other.

The pusher fingers 4 are moved to the non-retracted position at the end of the return stroke of the carriage 6. This return stroke of the carriage 6 is slightly longer than that possible for the support arms 5, limited by the buffer abutment members 15. On arrival of the carriage at its idle position, the thrust exerted by the abutment member 15 on the ends of the support arms is transmitted to the crossmember 50 and to the pin 58. The pin 58, guided along the edge of the pawl, is locked into the notch 96 to establish a non-elastic coupling between the carriage 6 and the support arms 5 for its forward stroke. This thrust compresses the springs 55 and causes displacement in the direction of the arrow fa of the support arms 5 relative to the carriage 6, to move them to the position shown in full line in FIG. 3. During this displacement in the direction of the arrow fa, the opening 51 has slid on the pin 40 and, at the same time, the rollers 42 have moved up the ramps 52 to position themselves on the plateaus and hold the ends of the pusher fingers 4 projecting from their support arms.

During this forward stroke, the abutment member 12 is retracted by the solenoid. The pusher fingers laterally sweep the level of the plate 10 in order to move the bundle from the plate 10 to the table 7 which receives it and form an abutment member for this bundle on the table, during their insertion into the envelope 20.

As soon as insertion of the table 7 into the envelope 20 begins, the new bundle may arrive already made up or may be made up on the plate 10 closed by the abutment member 12. The duration of the end of the forward stroke is thus added to the duration of the return stroke for feeding a new bundle to the entry station 1.

In order to place the bundle in an envelope, the combination of the table 7 and bundle is inserted into the envelope. Given these conditions, the bundle is protected by the table, even if a jam should occur.

To allow for the placing in envelopes of bundles of different sizes, the table 7 on its carriage 8 is of adjustable length and width relative to references related to the carriage 6 driven between its two defined limiting positions, the working and idle positions.

The table 7 is formed by a set of three plates of the same length, a central plate 72 and two side plates 73 and 74 beyond which the central plate 72 projects slightly (FIG. 2). This assembly formed by the three plates defines, in front of the pusher fingers 4, the forward part 70 of the table 7. The other part is coupled to the auxiliary carriage 8.

For adjusting the width 1 of the table 7, as shown in FIG. 2 the central plate 72 is fixed directly to the auxiliary carriage 8 and each of the side plates 73, 74 is fixed through the intermediary of a support 75. The supports 75 are aligned with the auxiliary carriage 8. Both are threaded and receive a threaded rod 80 for adjusting the width of the table 7. This rod 80 has lefthand and righthand threads engaged in the corresponding threads in the supports 75 so as to secure simultaneous displacement of the side plates in opposite directions relative to the central plate and thus to adjust the width 1 of the table 7.

The threaded rod 80 carries a bevel gear 81 coupled to a bevel gear 82 carried by a drive transmission rod 83. This rod 83 is mounted by means of bearings on the auxiliary carriage and the carriage 6, through which it passes. The drive transmission rod 83 is coupled externally of the carriage 6 to a rod 85 operated by a square key; this coupling is effected by bevel gears 86 and 87 mounted on the rods 83 and 85, respectively (FIGS. 1 and 2).

The table 7 is also adjustable in length forward of the carriage 6. In FIG. 2 this dimension is denoted L. It is adjustable relative to a reference defined relative to the carriage 6 and consisting of the edge of the shelf 64 fixed to the carriage 6.

This adjustment of the dimension L is obtained by means of the side rods 65 linking the carriage 6 and the auxiliary carriage 8. These rods are partially threaded. They are locked longitudinally into the walls of the carriage 6 and are inserted into threaded crossmembers 88 of the carriage 8. They carry at their end external to the carriage 6 a toothed wheel 66 for coupling them via a system 67 disposed between these toothed wheels 66. One of them is also coupled at this end to a rod adapted to be operated by a square key, not visible but analogous to the rod 85, by a pair of bevel gears 68, 69 which they respectively carry.

These adjustments of the length and width of the table eliminate any constraint with regard to the dimensions of the bundles to be placed in envelopes.

The present invention has been described with reference to the embodiment shown. It is obvious that it is possible, without departing from the scope of the invention, to replace certain means by other equivalent means or to effect detail modifications. In particular, the plate 10 of the entry station may be equipped with a conveyor belt driven during the time that the abutment member 12 which closes off the passage for the bundle from the plate 10 to the table 7 is retracted. In this variant, the forward stroke and the return stroke of the drive carriage are consequently shorter than those indicated hereinabove, the pusher fingers simply underlying the abutment member 12 in the idle position of the carriage. These pusher fingers are operated in an analogous manner, however: they are retracted for the return stroke of the carriage and they are placed in the non-retracted position for the forward stroke of the carriage.

There is claimed:

1. Device for inserting bundles into envelopes, comprising:

a fixed bundle entry station defined by a fixed horizontal plate for supporting said bundle, a fixed open envelope holding station for supporting an envelope open, facing and spaced from said entry station, guides extending horizontally beneath said entry station, and a carriage mounted on said guides and movable horizontally in translation on said guides, a bundle receiving table carried by said carriage and movable under said entry station, drive means having a forward stroke and a return stroke for reciprocating said carriage between a working position in which said table is inserted in the envelope and an idle position below said entry station, retractable pusher fingers, parallel support arms extending between the entry station and said table and means on said support arms for pivotably mounting said pusher fingers from first end portions of said support arms and for moving said pusher fingers longitudinally relative to said support arms for raising said pusher fingers to form an abutment for said bundle on the forward stroke and for lowering said pusher fingers on the return stroke, coupling means between said support arms and said carriage comprising at least elastic first linking means for relative translation to the extent of said longitudinal movement of said pusher fingers on said support arms, between the forward stroke and the return stroke and vice-versa, and means responsive to translational movement of said carriage for raising said pusher fingers respectively on said support arms to form an abutment for pushing the bundle off said plate onto said table and into said envelope and lowering thereof upon return under said plate.

2. Device according to claim 1, further comprising a crossmember linking said support arms, an angle bracket fixed to said carriage and springs constituting said elastic first linking means disposed between said crossmember and said angle bracket.

3. Device according to claim 2, further comprising a shelf carried by said carriage to which said angle bracket is fixed and which has two folded over longitudinal edges and two angle brackets which extend along the inside and the outside of said support arms.

4. Device according to claim 1, wherein a pin pivotably mounts said pusher fingers to said first end portions of said support arms and spring rods extending under tension between said pin and said carriage and an oblong opening in the end portions of said support arms providing said longitudinal play of said support arms relative to said pin.

5. Device according to claim 4, wherein said pusher fingers are of inverted U shape and disposed over said end portions of said support arms and said pin is disposed between the sides of the U shape of the pusher fingers and within said oblong opening.

6. Device according to claim 5, wherein said end portions of said support arms each include a ramp for guiding the pusher finger which it carries into the retracted position and a horizontal plateau adjacent said ramp for holding said pusher finger in the raised position and each of said pusher fingers carries an inside roller which bears on said plateau and said ramp, according to the position of said oblong opening on said second pin.

7. Device for inserting bundles into envelopes, comprising:

a fixed bundle entry station defined by a fixed horizontal plate for supporting said bundle, a fixed open envelope holding station for supporting an envelope open, facing and spaced from said entry station, guides extending horizontally beneath said entry station, and a carriage mounted on said guides and movable in translation on said guides, a bundle receiving table carried by said carriage and movable under said entry station, drive means having a forward stroke and a return stroke for reciprocating said carriage between a working position in which said table is inserted in the envelope and an idle position below said entry station, retractable pusher fingers, parallel support arms extending between the entry station and said table and means on said support arms for pivotably mounting said pusher fingers from first end portions of said support arms for longitudinal movement along said arms for raising said pusher fingers to form an abutment for said bundle on the forward stroke and for lowering said pusher fingers on the return stroke, coupling means between said support arms and said carriage comprising at least elastic first linking means for relative translation to the extent of said longitudinal movement of said pusher fingers on said support arms, between the forward stroke and the return stroke and vice-versa, and means responsive to translational movement of said carriage for raising said pusher fingers respectively on said support arms to form an abutment for the bundle and lowering thereof, and wherein a pin pivotably mounts said pusher fingers to said first end portions of said support arms and spring rods extending under tension between said pin and said carriage and an oblong opening in the end portions of said support arms provide said longitudinal play of said support arms relative to said pin, wherein said coupling means comprise non-elastic second linking means, means for locking said second linking means at the end of the return stroke of said carriage and for simultaneously raising of said pusher fingers and means for unlocking said second linking means at the start of the return stroke of said carriage and for simultaneously retracting said pusher fingers.

8. Device according to claim 7, wherein said second linking means comprise a pin fixed to said support arms and a first pawl with a lateral notch for retaining said pin.

9. Device accordig to claim 8, wherein said locking means comprise a locking abutment member fixed in position in said device for limiting the end of travel of said support arms relative to that of said carriage causing displacement of said support arms in one direction along the pivot axis of said pusher fingers for raising said fingers and locking said pin in said notch of said first pawl.

10. Device according to claim 8, wherein said unlocking means comprise a second pawl fastened to said first pawl and having a lateral notch and an unlocking abutment member mounted to pivot within said device on the trajectory of said second pawl, forming an obstacle which is retractable under said second pawl at the end of the forward stroke of the carriage and an obstacle which is not retractable at the start of the return stroke of said carriage.

11. Device according to claim 10, wherein a hub mounted on said carriage rotatably mounts said pawls.

12. Device according to claim 1, further comprising an auxiliary carriage carrying said table coupled adjustably to said carriage.

13. Device according to claim 12, wherein threaded rods are locked onto said carriage and threaded bushes on said auxiliary carriage meshing with said threaded rods, whereby the width of said table may be adjusted relative to a fixed reference on said carriage.

14. Device according to claim 12, wherein said table comprises a plurality of plates mounted in horizontal side-by-side relationship on said auxiliary carriage and partially overlapping and means for laterally adjusting said plates relative to each other for adjusting the width of said table.

* * * * *